US009759020B2

(12) United States Patent
Smith et al.

(10) Patent No.: US 9,759,020 B2
(45) Date of Patent: Sep. 12, 2017

(54) ROD AND ROD CUP ALIGNMENT APPARATUS FOR DRILLING MACHINE

(71) Applicant: Atlas Copco Drilling Solutions, LLC, Garland, TX (US)

(72) Inventors: Donald W Smith, Garland, TX (US); Luke Bender, Sachse, TX (US)

(73) Assignee: Atlas Copco Drilling Solutions, LLC, Garland, TX (US)

( * ) Notice: Subject to any disclaimer, the term of this patent is extended or adjusted under 35 U.S.C. 154(b) by 0 days.

(21) Appl. No.: 15/004,007

(22) Filed: Jan. 22, 2016

(65) Prior Publication Data

US 2017/0211341 A1 Jul. 27, 2017

(51) Int. Cl.
*E21B 19/14* (2006.01)

(52) U.S. Cl.
CPC ..... *E21B 19/146* (2013.01)

(58) Field of Classification Search
CPC ..... Y10T 483/1809; E21B 19/146
USPC ..... 175/52, 85; 211/1.53, 60.1, 70.4; 414/22.51–22.59, 22.61–22.69, 22.71
See application file for complete search history.

(56) References Cited

U.S. PATENT DOCUMENTS

| | | | | |
|---|---|---|---|---|
| 435,973 | A | 9/1890 | Edward | |
| D995,064 | | 6/1911 | Frederickson | |
| 1,265,494 | A | 5/1918 | Packard | |
| 3,336,991 | A | 8/1967 | Klem | |
| 3,493,061 | A | 2/1970 | Gyongyosi | |
| 3,913,754 | A | 10/1975 | Swartz et al. | |
| 3,966,053 | A * | 6/1976 | Loftis | E21B 19/146 175/52 |
| 3,985,189 | A | 10/1976 | Jahnke et al. | |
| 4,049,065 | A | 9/1977 | Walter | |
| 4,258,796 | A | 3/1981 | Horning et al. | |
| 4,296,820 | A * | 10/1981 | Loftis | E21B 19/20 173/140 |

(Continued)

FOREIGN PATENT DOCUMENTS

| | | |
|---|---|---|
| AU | 486190 | 9/1977 |
| CA | 1050526 A1 | 3/1979 |

(Continued)

OTHER PUBLICATIONS

Finzi, A. Ercoli, et al. "SD2-How to sample a comet." Space science reviews128.1-4 (2007): 281-299.

(Continued)

*Primary Examiner* — Gregory Adams
(74) *Attorney, Agent, or Firm* — John A. Thomas

(57) ABSTRACT

A rod and rod cup alignment apparatus for a drilling machine has a receptacle for receiving a drill rod of the type having at least one rod flat, where the drill rod has a leading corner and a trailing corner relative to the direction of its rotation. The receptacle has at least one cup flat disposed on the inner surface of the receptacle and the cup flat further has a first top surface and a second top surface. The second top surface has a slope downward toward the bottom of the rod cup, so that, as the drill rod is lowered into the rod cup while the drill rod is rotating, the leading corner of the drill rod is caused to move downward along the second top surface, whereupon the trailing corner of the drill rod contacts the first top surface, thereby aligning the drill rod flat with the rod cup flat.

14 Claims, 4 Drawing Sheets

(56) References Cited

U.S. PATENT DOCUMENTS

| | | | | |
|---|---|---|---|---|
| 4,445,579 | A | 5/1984 | Bello | |
| 4,455,116 | A | 6/1984 | Lindstedt | |
| 4,892,160 | A | 1/1990 | Schivley, Jr. | |
| 5,125,148 | A * | 6/1992 | Krasnov | E21B 17/03 175/85 |
| 6,050,351 | A | 4/2000 | Eckenfels et al. | |
| 6,474,932 | B1 | 11/2002 | Rush | |
| 8,342,236 | B2 | 1/2013 | Bienfang | |
| 2013/0213715 | A1 | 8/2013 | Ferrari | |
| 2013/0277118 | A1 | 10/2013 | Koch et al. | |
| 2014/0083765 | A1 | 3/2014 | Hoult et al. | |
| 2014/0083774 | A1 | 3/2014 | Hoult et al. | |

FOREIGN PATENT DOCUMENTS

| | | | |
|---|---|---|---|
| EP | 0182500 | A1 | 5/1986 |
| EP | 0192622 | A2 | 8/1986 |
| EP | 2609278 | B1 | 4/2015 |

OTHER PUBLICATIONS

Antila, Matti, and Niklas Hoslsti. "Software development for a deep drilling micro rover for Mars exploration." Data Systems in Aerospace. vol. 509. 2002. http://adsabs.harvard.edu/ful1/2002esasp.509e . . .6a (First paragraph on second page).

Sager, William, et al. "Requirements for robotic underwater drills in US marine geologic research." JOI/USSAC Newsletter 16 (2003): 12-13.

Loftin, K., et al. "Integration and Ruggedization of a Commercially Available Gas Chromatograph and Mass Spectrometer (GCMS) for the Resource Prospector Mission (RPM)." Presentation to HEMS, Sep. 2014. http://ntrs.nasa.gov/archive/nasa/casi.ntrs.nasa.gov/20140002800.pdf.

* cited by examiner

ROD AND ROD CUP ALIGNMENT APPARATUS FOR DRILLING MACHINE

BACKGROUND

Technical Field

The present disclosure relates to the handling of drilling rods or pipes and additional devices for earth drilling; in particular, to the making and unmaking of a sequence of drilling rods in a drilling machine.

Background

Various drill rod carousel or magazine devices are in general use today with a drilling rig for handling and storing sections of drill rod. (The terms "drill rod" and "drill pipe" are considered interchangeable.) Drilling rigs of this type typically have an upright mast with a drill table or floor at the lower end thereof and a rotary drive mechanism (also called a "rotary head" or "top drive") mounted on the mast for linear movement along the mast as the drill string is drilled into the earth in a generally vertical direction. In conventional blast-hole drillings, the drilling angle may not be vertical, and often only shallow holes are necessary; therefore, one thirty to fifty-foot section of drill rod remains attached to the rotary head with a drill bit attached to the lower end thereof. As the drill rod is rotated, a downward force is controlled by the rotary head, causing the drill bit to drill the hole in the earth. When the drill bit has reached the required depth, it is retracted up into the mast, and the portable drilling rig is relocated to the next location where a blast hole is to be drilled.

When it becomes necessary, however, to drill holes deeper than the single pass capability of the drill, (i.e., the length of a single drill rod section, which may be shortened), a plurality of drill rod sections are attached end to end, forming a drill string for boring this deeper hole. In this case, the initial drilling section must be released from the rotary head and the following drill rod sections connected between the drill string and the rotary head. Conventionally, these following drill rod sections are carried by a drill rod carousel or magazine which is housed on or within the mast. The carousel rotates about an axis parallel to that of the drill hole in the earth and positions these drill rod sections in line with center line of the drill hole.

A typical drill rod carousel has a plurality of cups or sockets at the lower end thereof, each for retaining the lower end of a drill rod section. The end of the drill rod typically has flat surfaces for engaging corresponding flat surfaces in the cup. At the point the rod is put into the carousel, the joint between the drill rod and the rotary head is still at a relatively high torque from drilling. The rod is thus required to lock into the carousel cup so that the top drive can be unthreaded from the drill rod.

The drill rod carousel is pivotally connected to the mast so that it, as a unit, may pivot in or out from a stored position to an operating position where one of the drill rod sections is in line with the rotary head and drill hole. In this operating position, the rotary head is lowered to attach the rotary driving spindle to the male threads at the top of the drill rod. With this connection made, the rotary head is raised, removing the lower section of the drill rod from its carousel cup. Next, the carousel is pivoted back to the stored position, out of the way, so that the rotary head may be lowered and the lower end of the drill rod section connected to the upper end of the drill rod section already in the hole. In some drilling machines, the carousel is pivoted out of the way in front of the tower structure, but this has no effect on carousel operation.

After drilling a depth equal to the length of the drill rod section, the top of the section of drill rod remaining in the hole is secured to prevent it from rotating, the rotary head spindle is unscrewed from the drill string and the rotary head raised to the top of the mast so that the carousel may again be pivoted into place, aligning a following section of drill rod with the rotary head and drill hole, after which the process repeats itself as described.

Existing designs for drill rod cups in the carousel require the flats of the drill rod to be aligned with the flats of the cup; thus the rotation of the rod must be stopped before it enters the cup. Conventionally, a lead-in chamfer in the rod cup was provided to prevent jamming of the rod in the top of the cup, making it easier to get the drill rod to enter the cup. Entry of the rod into the cup to engage the flats is still difficult to achieve in the conventional design, as not all cups have an indication of where the flats are in the cup. Even with an indication of the location of the flats in the cup, if the angular alignment of the respective flats on the rod and in the rod cup is off by even a small angle, this may still prevent smooth entry of the rod into the cup. What is needed is a rod cup that allows the drill rod to drop down into the cup while rotating and engage the cup flats without further manual alignment by an operator.

The reader should note that this disclosure is not limited to the handling of drill rods for blast-hole drilling, but is applicable to other types of drilling, such as for water wells or petroleum-producing wells, or the handling of connected tubular parts generally.

SUMMARY

A rod and rod cup alignment apparatus for a drilling machine has a receptacle for receiving a drill rod of the type having at least one rod flat, where the drill rod has a leading corner and a trailing corner relative to the direction of its rotation. The receptacle has at least one cup flat disposed on the inner surface of the receptacle and the cup flat further has a first top surface and a second top surface. The second top surface has a slope downward toward the bottom of the rod cup, so that, as the drill rod is lowered into the rod cup while the drill rod is rotating, the leading corner of the drill rod is caused to move downward along the second top surface, whereupon the trailing corner of the drill rod contacts the first top surface, thereby aligning the drill rod flat with the rod cup flat.

DRAWINGS

Non-limiting embodiments of the present disclosure are described by way of example in the accompanying drawings, which are schematic and are not intended to be drawn to scale.

DETAILED DESCRIPTION

Figure 1:
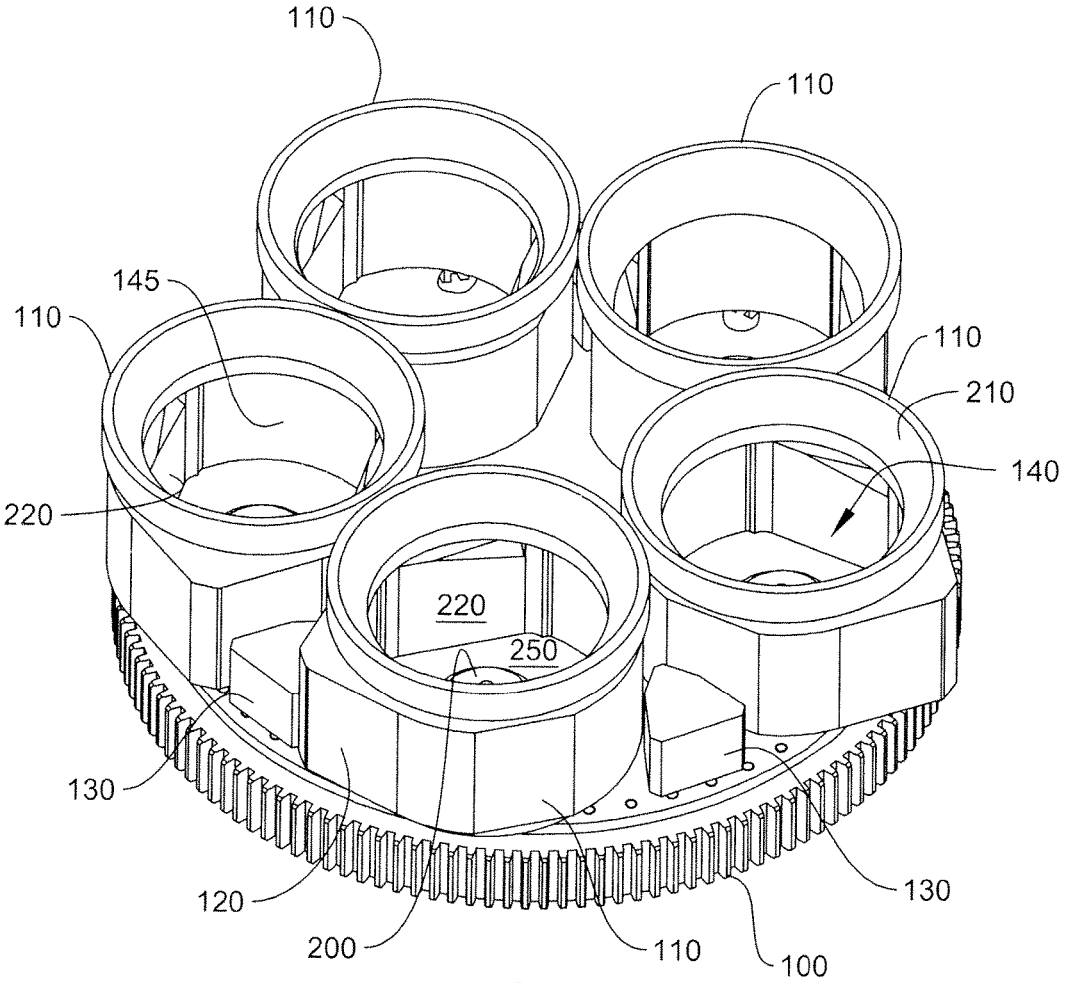
FIG. 1 is a perspective view of a typical drilling rig rod carousel, showing embodiments of the rod cups spaced around the carousel plate.

FIG. 1 shows a typical carousel plate 100, in this case supporting a plurality of rod cups 110 spaced around the carousel plate 100. Each rod cup 110 has a stop arm 120 for engaging stops 130 on the carousel plate 100, to stop the rotation of the rod cup 110 after a rotating drill rod 300 (see FIG. 4) engages the rod cup 110. In some applications, not relevant to this disclosure, adjacent cups or the center of the carousel, are used as stops. Each rod cup 110 has a central axle 200 (see FIG. 3B) engaging the carousel plate 100 to allow the rod cup 110 at least partial rotation. The rod cup defines a receptacle 140 for receiving a drill rod 300, and the receptacle 140 of the rod cup 110 has an inner surface 145. Other details of the rod cups 110 shown in FIG. 1 are discussed in the following paragraphs.

Figure 2:
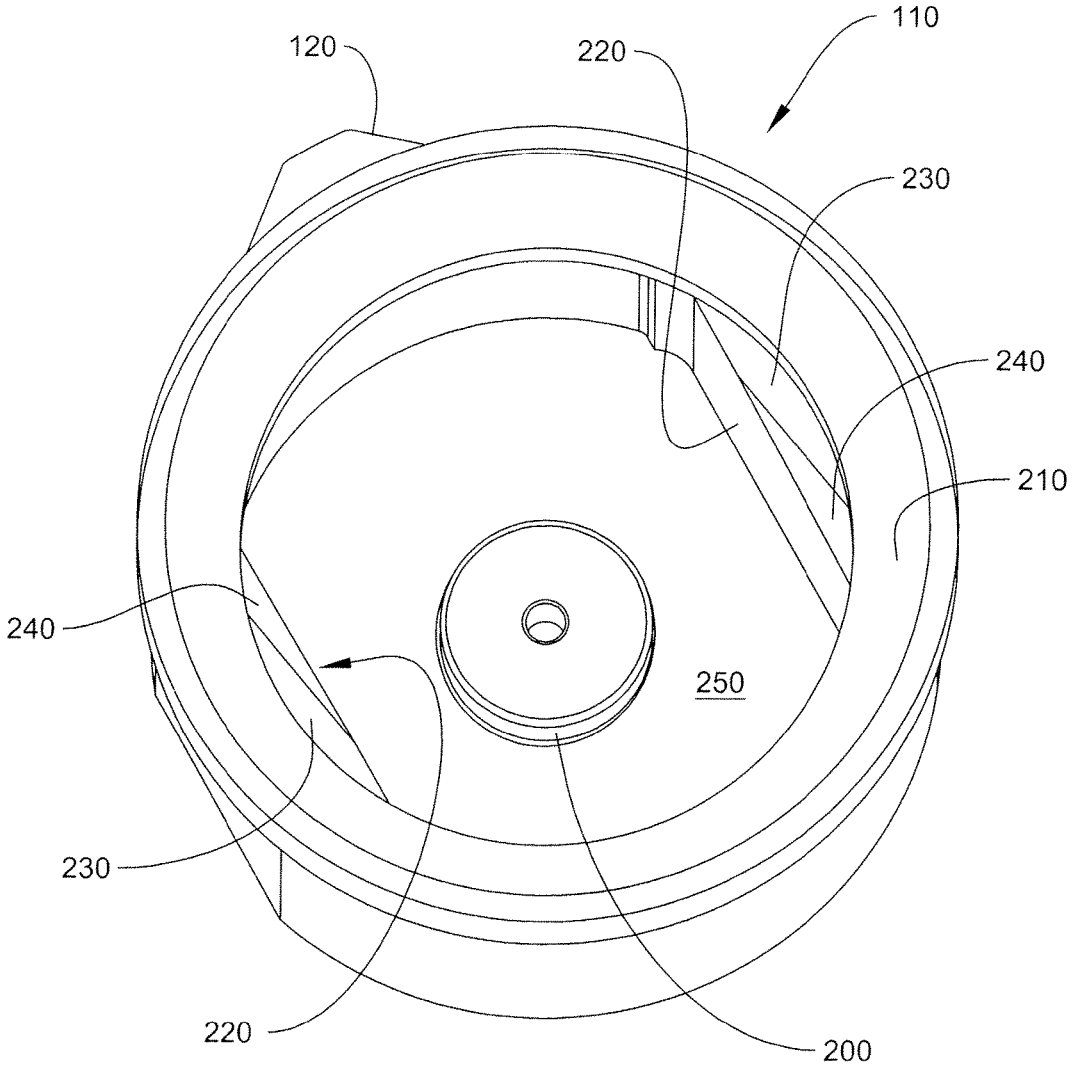
FIG. 2 is a generally top perspective view of an embodiment of the disclosed rod cup.

FIG. 2 is a top perspective view of a typical rod cup 110. The rod cup 110 may have an outer chamfer 210 to assist in guiding a drill rod 300 (see FIG. 4) into the rod cup 110. The body of the rod cup 110 has formed thereon a stop arm 120 for engaging stops 130 on the carousel plate 100 after the rod cup 110 is rotated by contact with a rotating drill rod 300. FIG. 2 shows two inner cup flats 220 inside the rod cup 110. In practice, one or more cup flats 220 may be present, depending on the number of drill rod flats 310 in use (See FIG. 4), but the number of flats is not important to this disclosure.

Figure 3A:
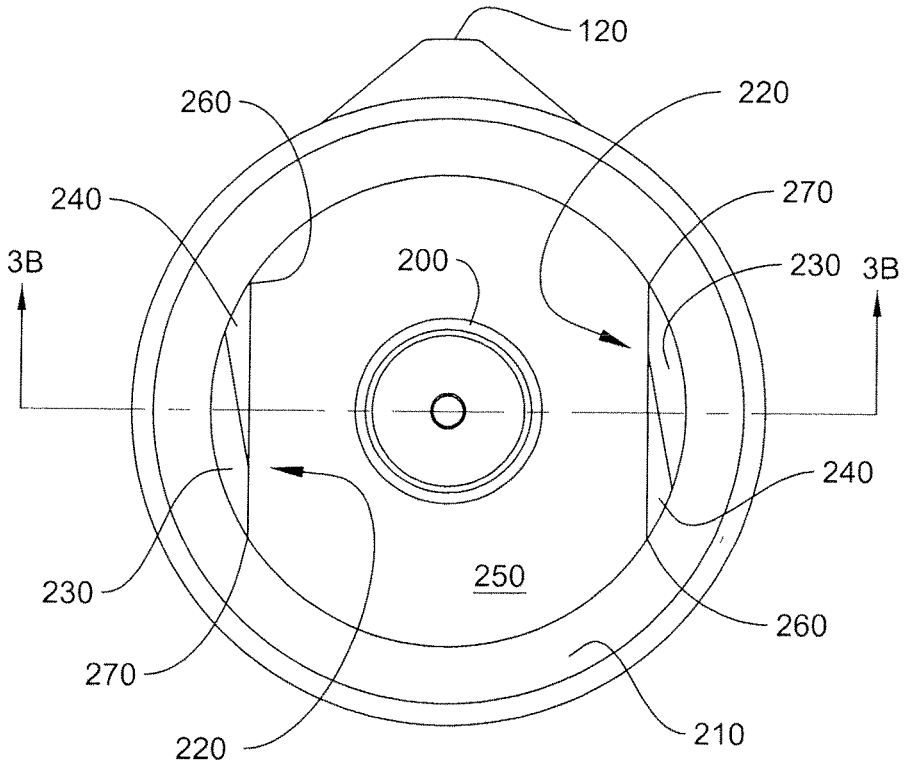
FIG. 3A is a top plan view of an embodiment of the disclosed rod cup.
Figure 3B:
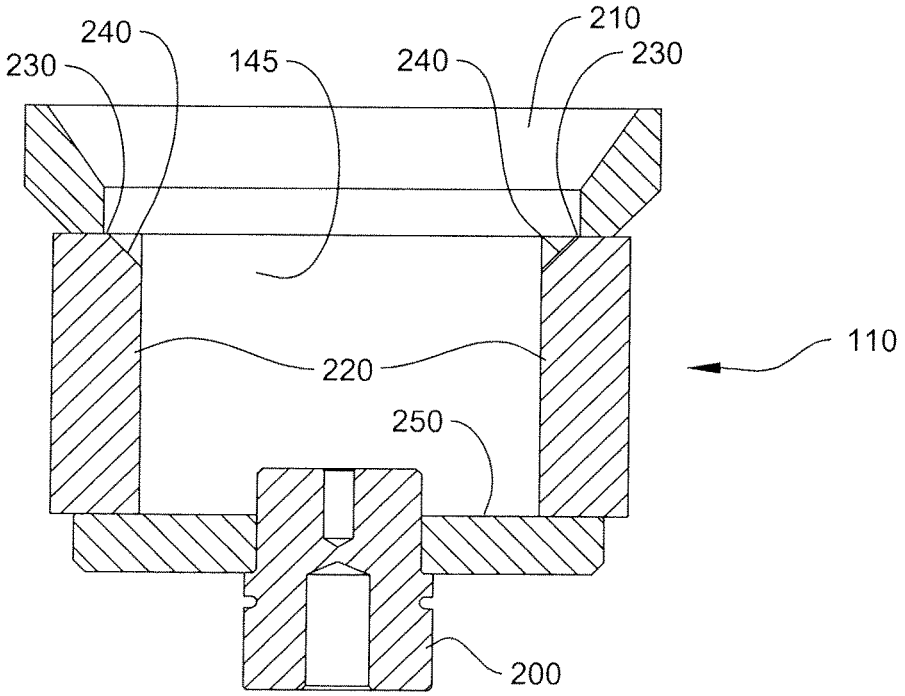
FIG. 3B is a cut-away side view of the embodiment of the rod cup shown in FIG. 3A.

Referring now to FIG. 2 and the top plan view of the rod cup 110 in FIG. 3A, each of the one or more cup flats 220 has a first top surface 230 that is substantially parallel with the bottom 250 of the rod cup 110. The first top surface 230 of the cup flat 220 is contiguous to a second top surface 240. The second top surface 240 of the cup flat 220 occupies a portion of the combined first top surface 230 and the second top surface 240, and slopes downward (i.e., toward the bottom 250 of the rod cup 110). The figures show that the first top surface 230 and the second top surface 240 of the cup flat 220 each occupy respectively about half of the combined top surfaces of the cup flat 220, but in other embodiments the first top surface 230 may occupy only a small portion of the cup flat 220. A slope of about 45 degrees for the second top surface 240 has been found to work satisfactorily, but any slope which allows the drill rod 300 to fall into rod cup 110, as described below, may be formed. Further the first top surface 230 and the second top surface 240 are not necessarily flat, but may have some radius of curvature. For further illustration of the structure of this embodiment, FIG. 3B is a cross-sectional view of the rod cup 110 shown in FIG. 3A.

Figure 4:
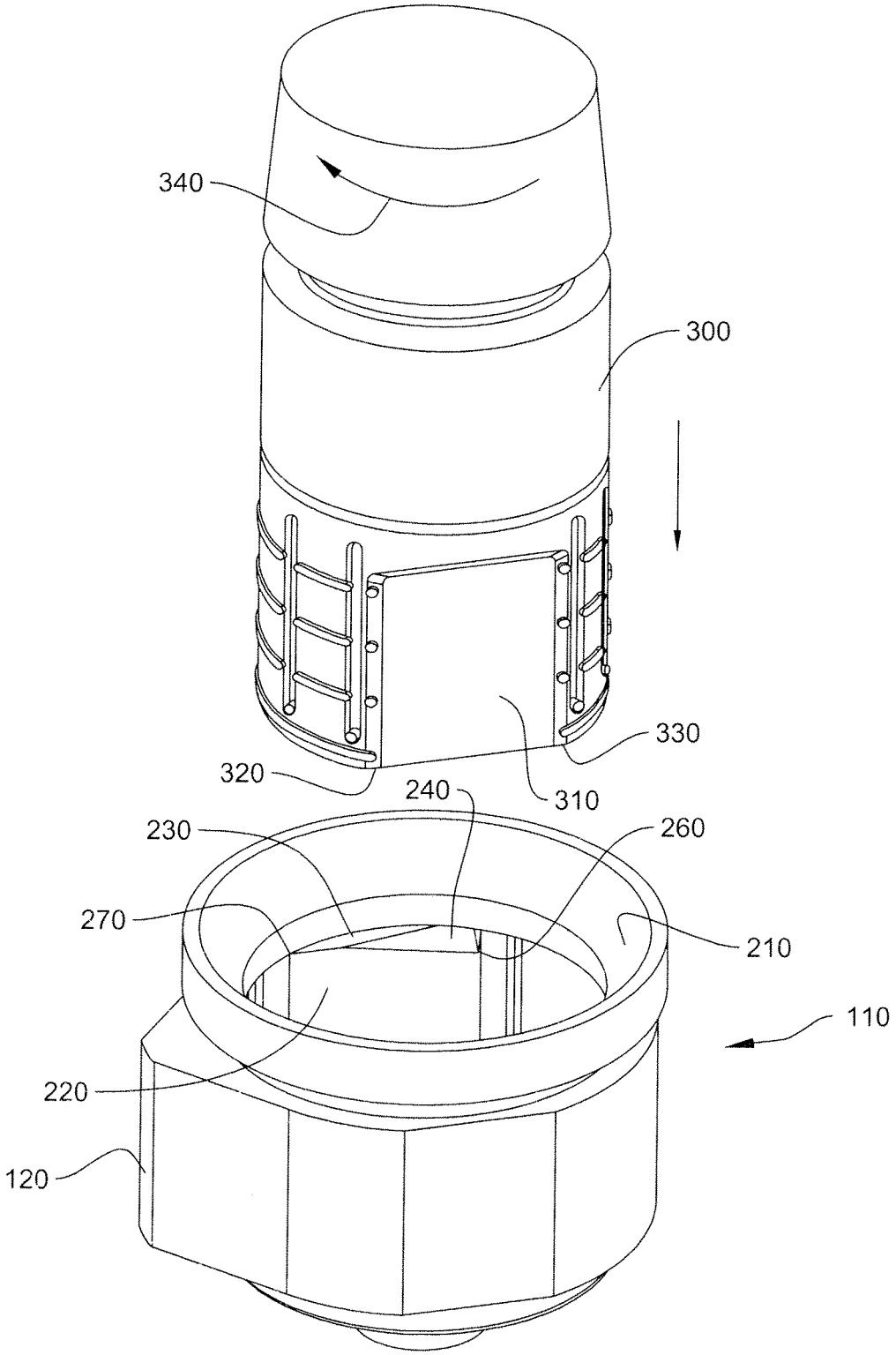
FIG. 4 is a perspective view of the engagement of a drill rod with an embodiment of the disclosed rod cup.

FIG. 4 is a perspective view of a typical engagement of a drill rod 300 into a rod cup 110. The drill rod 300 is shown with an arbitrary direction of rotation 340. The drill rod 300 has one or more drill rod flats 310 for engaging corresponding rod cup flats 220. Considered relative to the direction of rotation 340 of the drill rod 300, each drill rod flat 310 has a leading corner 320 and a trailing corner 330.

As the rotating drill rod 300, moving downward, enters the receptacle 140 of the rod cup 110, it contacts the first top surface 230 of the cup flat 220. As the drill rod 300 continues to rotate, the leading corner 320 of the drill rod 300 moves downward along the second, sloping, top surface 240. (Here, "downward" is into the rod cup 110). When the leading corner 320 of the drill rod 300 reaches the trailing edge 260 of the sloping second top surface 240 of the cup flat 220, the drill rod flats 310 and the cup flats 220 are aligned. The trailing corner 330 of the drill rod 300 will then contact the leading edge 270 of the first top surface 230 of the cup flat 220 and start the rod cup 110 rotating about its axle 200. The leading edge 270 is located higher in the rod cup 110 than the trailing edge 260. This rotation indicates to an operator that the drill rod flats 310 and the rod cup flats 220 are aligned, and the drill rod 300 can be safely lowered into the rod cup 110.

Note that the leading edge 270 of the first top surface 230 of the cup flat 220 has no shoulder where the cup flat 220 extends from the inner surface 145 of the rod cup 110, as is present in conventional rod cups.

The above-described engagement of the drill rod 300 with the rod cup 110 may be assisted if a floating sub (not shown) is connected to the drill rod 300 to relieve downward pressure on the rod cup 110, but embodiments shown will work without the use of a floating sub.

None of the description in this application should be read as implying that any particular element, step, or function is an essential element which must be included in the claim scope; the scope of patented subject matter is defined only by the allowed claims. Moreover, none of these claims are intended to invoke paragraph six of 35 U.S.C. Section 112 unless the exact words "means for" are used, followed by a gerund. The claims as filed are intended to be as comprehensive as possible, and no subject matter is intentionally relinquished, dedicated, or abandoned.

We claim:

1. A rod and rod cup alignment apparatus for a drilling machine; the apparatus comprising a rod cup; the rod cup comprising:

a receptacle for receiving a drill rod of the type having at least one rod flat;

where the drill rod has a leading corner and a trailing corner relative to the direction of its rotation;

the receptacle having a bottom;

at least one cup flat disposed on the inner surface of the receptacle;

the at least one cup flat further comprising:

a first top surface; and, a second top surface; the second top surface having a slope downward toward the bottom of the rod cup;

where the slope of the second top surface downward toward the bottom of the rod cup is approximately 45 degrees;

so that, as the drill rod is lowered into the rod cup while the drill rod is rotating, the leading corner of the drill rod is caused to move downward along the second top surface, and the trailing corner of the drill rod contacts the first top surface, thereby aligning the drill rod flat with the rod cup flat.

2. The rod and rod cup alignment apparatus of claim 1, where the at least one cup flat and the at least one rod flat comprise, respectively, a plurality of flats.

3. The rod and rod cup alignment apparatus of claim 2, where the plurality of flats is two, and the flats are spaced approximately 180 degrees apart in the rod cup and on the drill rod, respectively.

4. The rod and cup alignment apparatus of claim 1 where the second top surface has a radius of curvature.

5. The rod and rod cup alignment apparatus of claim 1, where the second top surface of the rod cup flat occupies approximately one-half of the combined area of the first top surface and the second top surface of the rod cup flat.

6. The rod and cup alignment apparatus of claim 1, where the first top surface is substantially parallel to the bottom of the rod cup.

7. The rod and rod cup alignment apparatus of claim 1, where the rod cup flat has no shoulder where the rod cup flat extends from the inner surface of the rod cup.

8. A rod and rod cup alignment apparatus for a drilling machine; the apparatus comprising a rod cup; the rod cup comprising:

a receptacle for receiving a drill rod of the type having at least one rod flat;

where the drill rod has a leading corner and a trailing corner relative to the direction of its rotation;

the receptacle having a bottom;

at least one cup flat disposed on the inner surface of the receptacle;

the at least one cup flat further comprising:

a first top surface; and, a second top surface; the second top surface having a slope downward toward the bottom of the rod cup;

where the second top surface of the rod cup flat occupies approximately one-half of the combined area of the first top surface and the second top surface of the rod cup flat;

so that, as the drill rod is lowered into the rod cup while the drill rod is rotating, the leading corner of the drill rod is caused to move downward along the second top surface, and the trailing corner of the drill rod contacts the first top surface, thereby aligning the drill rod flat with the rod cup flat.

9. The rod and rod cup alignment apparatus of claim 8, where the at least one cup flat and the at least one rod flat comprise, respectively, a plurality of flats.

10. The rod and rod cup alignment apparatus of claim 9, where the plurality of flats is two, and the flats are spaced approximately 180 degrees apart in the rod cup and on the drill rod, respectively.

11. The rod and rod cup alignment apparatus of claim 8, where the slope of the second top surface downward toward the bottom of the rod cup is approximately 45 degrees.

12. The rod and cup alignment apparatus of claim 9 where the second top surface has a radius of curvature.

13. The rod and cup alignment apparatus of claim 8, where the first top surface is substantially parallel to the bottom of the rod cup.

14. The rod and rod cup alignment apparatus of claim 8, where the rod cup flat has no shoulder where the rod cup flat extends from the inner surface of the rod cup.

* * * * *